US008897475B2

(12) United States Patent
Ball et al.

(10) Patent No.: US 8,897,475 B2
(45) Date of Patent: Nov. 25, 2014

(54) MAGNET ARRANGEMENT FOR BONE CONDUCTION HEARING IMPLANT

(71) Applicant: Vibrant Med-El Hearing Technology GmbH, Innsbruck (AT)

(72) Inventors: Geoffrey R. Ball, Axams (AT); Markus Nagl, Volders (AT)

(73) Assignee: Vibrant Med-El Hearing Technology GmbH, Innbruck (AT)

( * ) Notice: Subject to any disclaimer, the term of this patent is extended or adjusted under 35 U.S.C. 154(b) by 22 days.

(21) Appl. No.: 13/721,408

(22) Filed: Dec. 20, 2012

(65) Prior Publication Data

US 2013/0165738 A1 Jun. 27, 2013

Related U.S. Application Data

(60) Provisional application No. 61/578,953, filed on Dec. 22, 2011.

(51) Int. Cl.
*H04R 25/00* (2006.01)
*H04R 25/02* (2006.01)

(52) U.S. Cl.
CPC ..... *H04R 25/02* (2013.01); *H04R 25/606* (2013.01); *H04R 2460/13* (2013.01)
USPC ..... 381/326; 381/151; 600/12; 600/25

(58) Field of Classification Search
CPC .. H04R 25/606; H04R 2460/13; H04R 25/60; H04R 2225/67
USPC ..... 381/151, 326; 600/12, 25
See application file for complete search history.

(56) References Cited

U.S. PATENT DOCUMENTS 3,487,403 A 12/1969 Pihl ..... 340/373
3,573,812 A 4/1971 Pihl ..... 340/373

(Continued)

FOREIGN PATENT DOCUMENTS

EP 2031896 4/2009 ..... H04R 25/00
GB 1468890 3/1977

(Continued)

OTHER PUBLICATIONS

Bromberg & Sunstein LLP, Response A filed May 14, 2007 to Office Action dated Feb. 12, 2007, pertaining to U.S. Appl. No. 11/158,322, 11 pages.

(Continued)

*Primary Examiner* — Curtis Kuntz
*Assistant Examiner* — Ryan Robinson
(74) *Attorney, Agent, or Firm* — Sunstein Kann Murphy & Timbers LLP

(57) ABSTRACT

An implantable magnet arrangement is described for a hearing implant in a recipient patient. A pair of implant magnets are fixable in a common plane beneath the skin of the patient to underlying skull bone. At least one of the magnets is adapted to transform a magnetic drive signal from an external signal drive coil into a corresponding mechanical stimulation signal for delivery by bone conduction of the skull bone as an audio signal to the cochlea. Each implant magnet includes a pair of internal magnets lying in parallel planes which meet along a common junction with repelling like magnetic polarities facing towards each other, and the magnetic polarities of each implant magnet are reversed from each other.

10 Claims, 4 Drawing Sheets

(56) References Cited

U.S. PATENT DOCUMENTS

| | | | | |
|---|---|---|---|---|
| 3,801,767 | A | 4/1974 | Marks | 200/161 |
| 3,987,967 | A | 10/1976 | Kuznetsov et al. | 241/1 |
| 4,038,990 | A | 8/1977 | Thompson | 128/419 PG |
| 4,199,741 | A | 4/1980 | Serrus Paulet | 335/206 |
| 4,257,936 | A | 3/1981 | Matsumoto et al. | 524/413 |
| 4,317,969 | A | 3/1982 | Riegler et al. | 200/52 R |
| 4,549,532 | A | 10/1985 | Baermann | 600/15 |
| 4,596,971 | A | 6/1986 | Hirabayashi et al. | 335/205 |
| 4,628,907 | A | 12/1986 | Epley | 128/1.6 |
| 4,785,816 | A | 11/1988 | Dow et al. | 128/660 |
| RE32,947 | E | 6/1989 | Dormer et al. | 128/420.6 |
| 4,868,530 | A | 9/1989 | Ahs | 335/207 |
| 4,918,745 | A | 4/1990 | Hutchison | 455/41 |
| 5,015,224 | A | 5/1991 | Maniglia | 600/25 |
| 5,183,056 | A | 2/1993 | Dalen et al. | 128/782 |
| 5,434,549 | A | 7/1995 | Hirabayashi et al. | 335/229 |
| 5,456,654 | A | 10/1995 | Ball | 600/25 |
| 5,538,219 | A | 7/1996 | Osterbrink | 251/129.15 |
| 5,554,096 | A | 9/1996 | Ball | 600/25 |
| 5,624,376 | A | 4/1997 | Ball et al. | 600/25 |
| 5,630,835 | A | 5/1997 | Brownlee | 607/60 |
| 5,716,407 | A | 2/1998 | Knapp et al. | 623/11 |
| 5,724,014 | A | 3/1998 | Leikus et al. | 335/4 |
| 5,749,912 | A | 5/1998 | Zhang et al. | 607/57 |
| 5,800,336 | A | 9/1998 | Ball et al. | 600/25 |
| 5,857,958 | A | 1/1999 | Ball et al. | 600/25 |
| 5,877,664 | A | 3/1999 | Jackson, Jr. | 335/205 |
| 5,897,486 | A | 4/1999 | Ball et al. | 600/25 |
| 5,913,815 | A | 6/1999 | Ball et al. | 600/25 |
| 6,040,762 | A | 3/2000 | Tompkins | 340/426 |
| 6,067,474 | A | 5/2000 | Schulman et al. | 607/57 |
| 6,175,767 | B1 | 1/2001 | Doyle, Sr. | 607/57 |
| 6,178,079 | B1 | 1/2001 | Renger | 361/118 |
| 6,178,353 | B1 | 1/2001 | Griffith et al. | 607/61 |
| 6,190,305 | B1 | 2/2001 | Ball et al. | 600/25 |
| 6,208,235 | B1 | 3/2001 | Trontelj | 340/10.1 |
| 6,208,882 | B1 | 3/2001 | Lenarz et al. | 600/379 |
| 6,217,508 | B1 | 4/2001 | Ball et al. | 600/25 |
| 6,219,580 | B1 | 4/2001 | Faltys et al. | 607/57 |
| 6,292,678 | B1 | 9/2001 | Hall et al. | 600/374 |
| 6,295,472 | B1 | 9/2001 | Rubinstein et al. | 607/55 |
| 6,313,551 | B1 | 11/2001 | Hazelton | 310/12 |
| 6,348,070 | B1 | 2/2002 | Teissl et al. | 623/11.11 |
| 6,358,281 | B1 | 3/2002 | Berrang et al. | 623/10 |
| 6,475,134 | B1 | 11/2002 | Ball et al. | 600/25 |
| 6,505,062 | B1 | 1/2003 | Ritter et al. | 600/407 |
| 6,506,987 | B1 | 1/2003 | Woods | 290/61.62 |
| 6,522,909 | B1 | 2/2003 | Garibaldi et al. | 600/424 |
| 6,838,963 | B2 * | 1/2005 | Zimmerling et al. | 335/205 |
| 7,091,806 | B2 | 8/2006 | Zimmerling et al. | 335/207 |
| 7,190,247 | B2 * | 3/2007 | Zimmerling | 335/205 |
| 7,266,209 | B1 | 9/2007 | House | 381/331 |
| 7,338,035 | B2 | 3/2008 | Tsai | 267/136 |
| 7,566,296 | B2 | 7/2009 | Zimmerling et al. | 600/25 |
| 7,608,035 | B2 | 10/2009 | Farone | 600/9 |
| 7,609,061 | B2 * | 10/2009 | Hochmair | 324/307 |
| 7,642,887 | B2 | 1/2010 | Zimmerling | 335/296 |
| 8,634,909 | B2 * | 1/2014 | Zimmerling et al. | 607/3 |
| 2004/0012470 | A1 | 1/2004 | Zimmerling et al. | 335/207 |
| 2005/0062567 | A1 | 3/2005 | Zimmerling et al. | 335/150 |
| 2006/0244560 | A1 | 11/2006 | Zimmerling et al. | 335/207 |
| 2007/0191673 | A1 | 8/2007 | Ball et al. | 600/25 |
| 2007/0274551 | A1 | 11/2007 | Tsai et al. | 381/326 |
| 2008/0009920 | A1 * | 1/2008 | Gibson et al. | 607/57 |
| 2009/0209806 | A1 | 8/2009 | Hakansson | 600/25 |
| 2009/0248155 | A1 * | 10/2009 | Parker | 623/10 |
| 2010/0004716 | A1 | 1/2010 | Zimmerling et al. | 607/57 |
| 2010/0145135 | A1 | 6/2010 | Ball et al. | 600/25 |
| 2010/0324355 | A1 | 12/2010 | Spitaels et al. | 600/25 |
| 2011/0022120 | A1 * | 1/2011 | Ball et al. | 607/57 |
| 2011/0216927 | A1 | 9/2011 | Ball | 381/313 |

FOREIGN PATENT DOCUMENTS

| | | | | |
|---|---|---|---|---|
| JP | 04/023821 | | 1/2004 | H04R 25/00 |
| SU | 1690749 | | 11/1991 | A61F 11/04 |
| WO | WO 97/32629 | | 9/1997 | A61N 1/32 |
| WO | WO 00/10361 | | 2/2000 | |
| WO | WO 03/036560 | A2 | 5/2003 | G06K 11/18 |
| WO | WO 03/081976 | A2 | 10/2003 | |
| WO | WO 03/092326 | A1 | 11/2003 | H04R 25/00 |
| WO | WO 2004/114723 | | 12/2004 | H04R 25/00 |

OTHER PUBLICATIONS

Bromberg & Sunstein LLP, Response B filed Jun. 17, 2008 to Office Action dated Mar. 17, 2008, pertaining to U.S. Appl. No. 11/158,322, 10 pages.

Bromberg & Sunstein LLP, Response C filed Sep. 19, 2008 to Office Action dated Jun. 26, 2008, pertaining to U.S. Appl. No. 11/671,132, 8 pages.

Bromberg & Sunstein LLP, Response D filed Jan. 5, 2009 to Office Action dated Oct. 27, 2008, pertaining to U.S. Appl. No. 11/671,132, 13 pages.

European Patent Office, European Search Report (Extended) pertaining to Application No. 08075886.5-2205/12031896, date of mailing Jun. 3, 2009, 8 pages.

Heller et al, "Evaluation of MRI Compatibility of the Modified Nucleus Multichannel Auditory Brainstem and Cochlear Implants", *The American J. Of Otology* 17(5); pp. 724-729 (Sep. 1996).

Hobbs, et al, "Magnetic Resonance Image—Guided Proteomics of Human Glioblastoma Multiforme", *Journal of Magnetic Resonance Imaging*; pp. 530-536 (2003).

International Searching Authority, International Search Report International Application No. PCT/IB03/02283, date of mailing Nov. 28, 2003, 4 pages.

International Searching Authority, Invitation to Pay Additional Fees—International Application No. PCT/IB2004/002588, date of mailing Dec. 20, 2004, 4 pages.

Teissl et al, "Cochlear Implants: In Vitro Investigation of Electromagnetic Interference at MR Imaging Compatibility and Safety Aspects", *Radiology* 208(3); pp. 700-708 (Sep. 1998).

Teissl et al, "Magnetic Resonance Imaging and Cochlear Implants: Compatibility and Safety Aspects", *J. Magn. Reson. Imaging* 9(1); pp. 26-38 (Jan. 1999).

United States Patent and Trademark Office, Office Action dated Feb. 12, 2007, pertaining to U.S. Appl. No. 11/158,322, 6 pages.

United States Patent and Trademark Office, Office Action dated Mar. 17, 2008, pertaining to U.S. Appl. No. 11/158,322, 14 pages.

United States Patent and Trademark Office, Office Action dated Oct. 27, 2008, pertaining to U.S. Appl. No. 11/671,132, 7 pages.

International Searching Authority, Authorized Officer Lee W. Young, International Search Report and Written Opinion, PCT/US11/41045, mailed Oct. 25, 2011, 10 pages.

International Searching Authority, Authorized Officer Shane Thomas, International Search Report and Written Opinion, PCT/US12/70823, date of mailing Mar. 13, 2013, 13 pages.

* cited by examiner

MAGNET ARRANGEMENT FOR BONE CONDUCTION HEARING IMPLANT

This application claims priority from U.S. Provisional Patent Application 61/578,953, filed Dec. 22, 2001, which is incorporated herein by reference.

FIELD OF THE INVENTION

The present invention relates to medical implants, and more specifically to a novel transcutaneous auditory prosthetic implant system.

BACKGROUND ART

A normal ear transmits sounds as shown in FIG. 1 through the outer ear 101 to the tympanic membrane (eardrum) 102, which moves the ossicles of the middle ear 103 (malleus, incus, and stapes) that vibrate the oval window 106 and round window 107 membranes of the cochlea 104. The cochlea 104 is a long narrow duct wound spirally about its axis for approximately two and a half turns. It includes an upper channel known as the scala vestibuli and a lower channel known as the scala tympani, which are connected by the cochlear duct. The cochlea 104 forms an upright spiraling cone with a center called the modiolar where the spiral ganglion cells of the cochlear nerve 105 reside. In response to received sounds transmitted by the middle ear 103, the fluid-filled cochlea 104 functions as a transducer to generate electric pulses which are transmitted to the cochlear nerve 105, and ultimately to the brain.

Hearing is impaired when there are problems in the ability to transduce external sounds into meaningful action potentials along the neural substrate of the cochlea 104. To improve impaired hearing, auditory prostheses have been developed. For example, when the impairment is related to operation of the middle ear 103, a conventional hearing aid or middle ear implant may be used to provide acoustic-mechanical stimulation to the auditory system in the form of amplified sound. Or when the impairment is associated with the cochlea 104, a cochlear implant with an implanted stimulation electrode can electrically stimulate auditory nerve tissue with small currents delivered by multiple electrode contacts distributed along the electrode.

Middle ear implants employ electromagnetic transducers to convert sounds into mechanical vibration of the middle ear 103. A coil winding is held stationary by attachment to a non-vibrating structure within the middle ear 103 and microphone signal current is delivered to the coil winding to generate an electromagnetic field. A magnet is attached to an ossicle within the middle ear 103 so that the magnetic field of the magnet interacts with the magnetic field of the coil. The magnet vibrates in response to the interaction of the magnetic fields, causing vibration of the bones of the middle ear 103. See U.S. Pat. No. 6,190,305, which is incorporated herein by reference.

U.S. Patent Publication 20070191673 (incorporated herein by reference) described another type of implantable hearing prosthesis system which uses bone conduction to deliver an audio signal to the cochlea for sound perception in persons with conductive or mixed conductive/sensorineural hearing loss. An implanted floating mass transducer (FMT) is affixed to the temporal bone. In response to an externally generated electrical audio signal, the FMT couples a mechanical stimulation signal to the temporal bone for delivery by bone conduction to the cochlea for perception as a sound signal. A certain amount of electronic circuitry must also be implanted with the FMT to provide power to the implanted device and at least some signal processing which is needed for converting the external electrical signal into the mechanical stimulation signal and mechanically driving the FMT.

One problem with implantable hearing prosthesis systems arises when the patient undergoes Magnetic Resonance Imaging (MRI) examination. Interactions occur between the implant magnet and the applied external magnetic field for the MRI. The external magnetic field from the MRI may create a torque on the implant magnet, which may displace the magnet or the whole implant housing out of proper position and/or may damage the adjacent tissue in the patient. The implant magnet may also cause imaging artifacts in the MRI image, there may be induced voltages in the receiving coil, and hearing artifacts due to the interaction of the external magnetic field of the MRI with the implanted device.

Thus, for existing implant systems with magnet arrangements, it is common to either not permit MRI or at most limit use of MRI to lower field strengths. Other existing solutions include use of a surgically removable magnets, spherical implant magnets (e.g. U.S. Pat. No. 7,566,296), and various ring magnet designs (e.g., U.S. Provisional Patent 61/227,632, filed Jul. 22, 2009). Among those solutions that do not require surgery to remove the magnet, the spherical magnet design may be the most convenient and safest option for MRI removal even at very high field strengths. But the spherical magnet arrangement requires a relatively large magnet much larger than the thickness of the other components of the implant, thereby increasing the volume occupied by the implant. This in turn can create its own problems. For example, some systems, such as cochlear implants, are implanted between the skin and underlying bone. The "spherical bump" of the magnet housing therefore requires preparing a recess into the underlying bone. This is an additional step during implantation in such applications which can be very challenging or even impossible in case of very young children.

U.S. patent application Ser. No. 13/163,965, filed Jun. 20, 2011, and incorporated herein by reference, described an implantable hearing prosthesis two planar implant magnets connected by a flexible connector member which are fixable to underlying skull bone. Each of the implant magnets was in the specific form of a center disk having magnetic polarity in one axial direction. Around the disk magnet was another ring magnet having an opposite magnetic polarity in a different direction. This ring/disk magnet arrangement had less magnetic interaction with an external magnetic field such as an MRI field.

SUMMARY

Embodiments of the present invention are directed to an implantable magnet arrangement for a hearing implant in a recipient patient. A pair of implant magnets are fixable in a common plane beneath the skin of the patient to underlying skull bone. One or both of the magnets is adapted to transform a magnetic drive signal from an external signal drive coil into a corresponding mechanical stimulation signal for delivery by bone conduction of the skull bone as an audio signal to the cochlea. Each implant magnet includes a pair of internal magnets lying in parallel planes which meet along a common junction with repelling like magnetic polarities facing towards each other, and the magnetic polarities of each implant magnet are reversed from each other.

The arrangement may further include a connector member flexibly connecting and positioning the implant magnets a fixed distance from each other. At least one of the implant magnets may be adapted for fixed attachment to the skull bone by a pair of radially opposed bone screws. Both of the implant magnets are adapted to transform the magnetic drive signal from the external signal drive coil into a corresponding mechanical stimulation signal for delivery by bone conduction of the skull bone as an audio signal to the cochlea. Each internal magnet may have a planar disk shape.

Each implant magnet may further include a magnet housing, for example of titanium material, enclosing the pair of internal magnets and holding them together against each other. In addition or alternatively, there may be a magnet connector nut and bolt combination holding the internal magnets together along the common junction. Embodiments may also include a magnet spacer insert lying along the common junction and separating the internal magnets.

Embodiments of the present invention also include a hearing implant system having an implantable magnet arrangement according to any of the foregoing.

DETAILED DESCRIPTION

Figure 1:
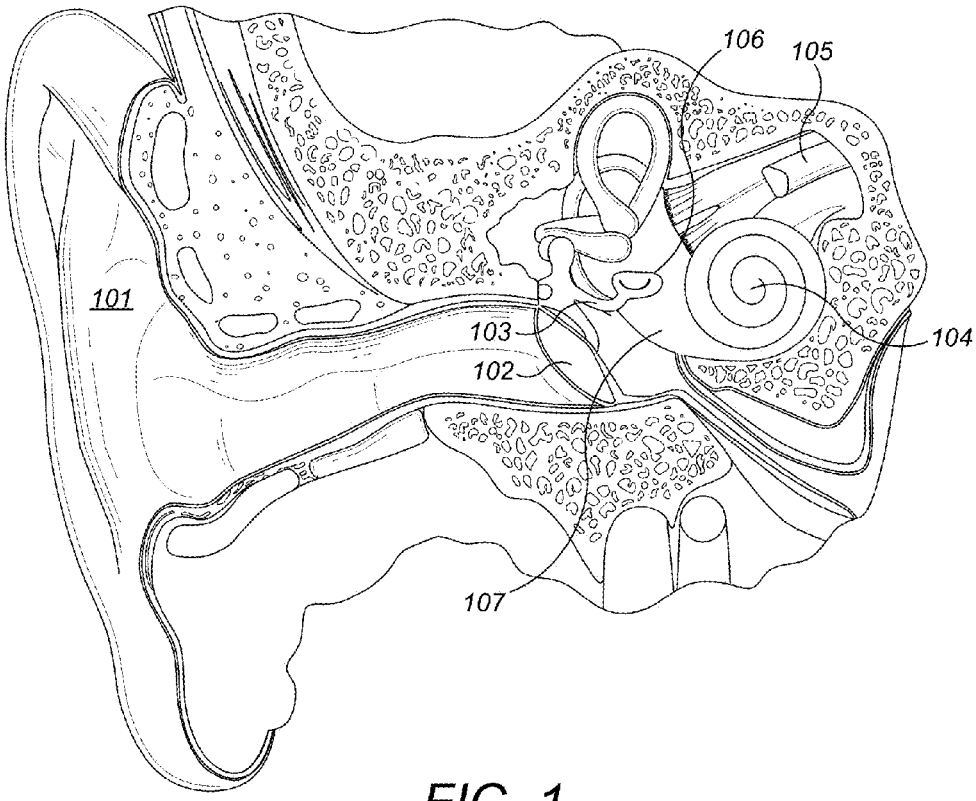
FIG. 1 shows anatomical structures of a typical human ear.
Figure 2:
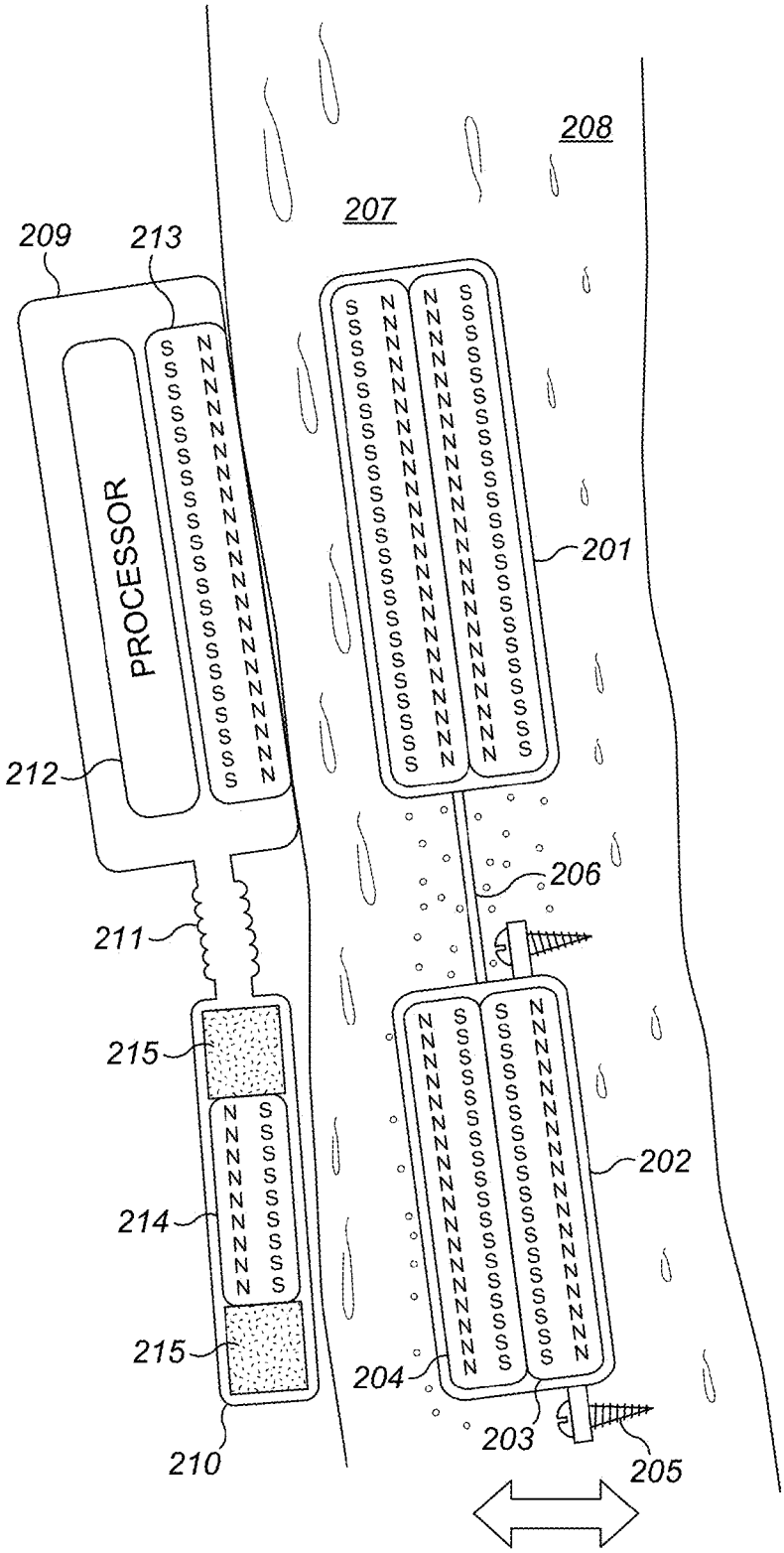
FIG. 2 shows a cross-sectional view of an implantable hearing prosthesis arrangement according to an embodiment of the present invention.

Embodiments of the present invention are directed to a magnetic arrangement for an implantable hearing prosthesis system which is compatible with MRI systems. FIG. 2 shows a cross-sectional view of an implantable hearing prosthesis arrangement having an implant holding magnet 201 and an implant transducer magnet 202 which are fixable in a common plane beneath the patient skin 207 to underlying skull bone 208. A flexible connector member 206 connects and positions the implant holding magnet 201 and the implant transducer magnet 202 a fixed distance from each other. The implant transducer magnet 202 is fixedly secured to the skull bone 208 by a pair of radially opposed bone screws 205.

The implant holding magnet 201 and the implant transducer magnet 202 are each enclosed within a titanium housing which contains a pair of internal magnets 203 and 204 in the shape of planar disks that lie in parallel planes which meet along a common junction with repelling like magnetic polarities facing towards each other. Thus, the internal magnets 203 and 204 within the housing of the implant transducer magnet 202 face each other with south magnetic fields facing towards each other and north magnetic fields facing outward. The magnetic polarities of the internal magnets 203 and 204 within the implant holding magnet 201 are reversed from those of the implant transducer magnet 202 so that north magnetic fields face towards each other and south magnetic fields face outward, and the magnet housing holds them together against each other.

The external elements of the system include a processor lobe 209 and a drive coil lobe 210 connected by a flexible connector 211. The processor lobe 209 contains a signal processor 212 that produces a communications signal to the implanted components and an external holding magnet 213 in the shape of a planar disk having a magnetic polarity opposite to the outermost internal magnet 204 of the implant holding magnet 201 so as to maximize the magnetic attraction between the two. The drive coil lobe 210 contains an external drive magnet 214 in the shape of a planar disk having a magnetic polarity opposite to the outermost internal magnet 204 of the implant transducer magnet 202 so as to maximize the magnetic attraction between the two. And because the outermost internal magnet 204 has different directions in the implant holding magnet 201 and the implant transducer magnet 202, that helps ensure that the processor lobe 209 aligns into proper position directly over the implant holding magnet 201 and the drive coil lobe 210 aligns into proper position over the implant transducer magnet 202.

An external drive coil 215 surrounds the outer perimeter of the external drive magnet 214. The external drive coil 215 receives the communications signal produced by the signal processor 212 and produces a corresponding electromagnetic drive signal that travels transcutaneously through the patient skin 207 where it interacts with the magnetic field of the outermost internal drive magnet 204 of the implant transducer magnet 202. This in turn causes the implant transducer magnet 202 to produce a corresponding mechanical stimulation signal for delivery by bone conduction of the skull bone 208 as an audio signal to the cochlea, which the patient perceives as sound.

To summarize, the magnetic polarity of the outermost internal magnet 204 in each of the implant magnets is closer to the skin surface and dominates in the near field so that there is magnetic attraction with the magnets in the external device. But with regards to an external far field magnetic field such as from an MRI, the magnetic polarities of the internal magnets 203 and 204 oppose and cancel each other, as does the opposing overall magnetic polarities of the implant holding magnet 201 and the implant transducer magnet 202. This net minimizing of the magnetic fields of the implant magnets reduces their magnetic interactions with the external MRI field to minimize adverse effects such as torque forces and imaging artifacts.

Figure 3:
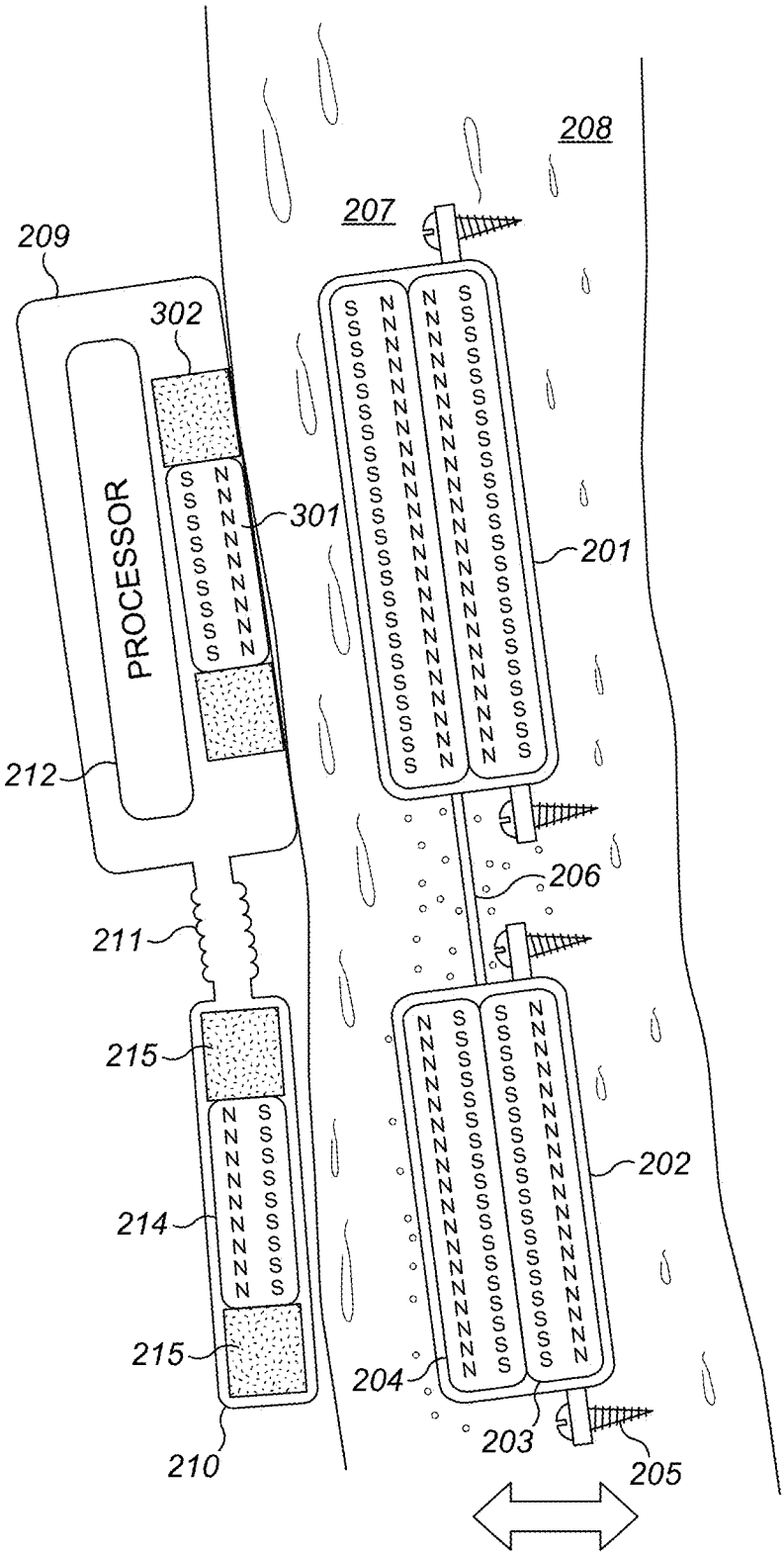
FIG. 3 shows a cross-sectional view of a different embodiment of an implantable hearing prosthesis.

FIG. 3 shows a cross-sectional view of a different embodiment of an implantable hearing prosthesis having a second processor drive coil 302 surrounding a processor drive magnet 301 in the processor lobe 209 of the external device. Thus the external device has two external drive coils 214 and 301 respectively, which magnetically interact with their respective implant magnets as shown, each of which generates a portion of the mechanical stimulation signal coupled into the skull bone 208.

Figure 4A:
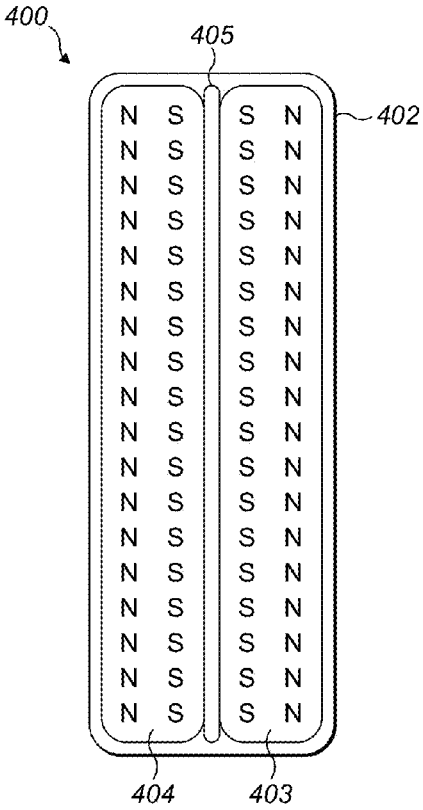
FIG. 4 A-B shows examples of arrangements for holding the magnetically opposing internal magnets together.
Figure 4B:
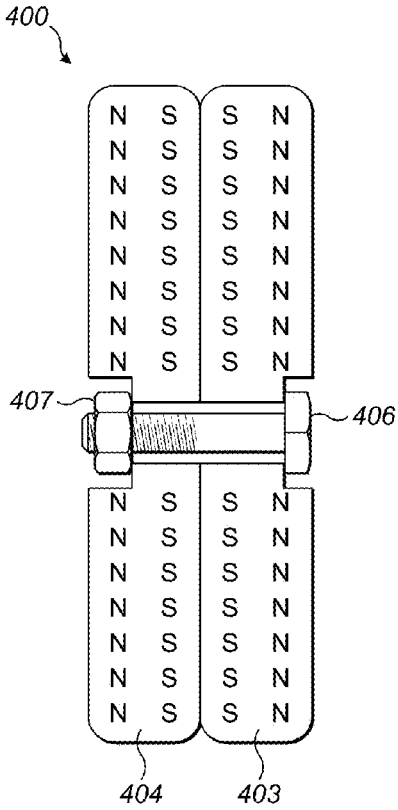

FIG. 4 A-B shows examples of different arrangements for holding the magnetically opposing internal magnets together. FIG. 4A shows an embodiment of an implant magnet 400 where the internal magnets 403 and 404 are enclosed within and held against each other by a titanium housing 402. The embodiment shown also includes a magnet spacer insert 405 that lies along the common junction and separates the internal magnets 403 and 404, thereby assisting in their easy assembly. FIG. 4 B shows another arrangement where a combination of a magnet connector nut 407 and a magnet connector bolt 406 hold the internal magnets 403 and 404 together along their common junction for ease of assembly.

Although various exemplary embodiments of the invention have been disclosed, it should be apparent to those skilled in the art that various changes and modifications can be made which will achieve some of the advantages of the invention without departing from the true scope of the invention.

What is claimed is:

1. An implantable magnet arrangement for a hearing implant in a recipient patient, the arrangement comprising:

a pair of implant magnets fixable in a common plane beneath the skin of the patient to underlying skull bone, at least one of the magnets being adapted to transform a magnetic drive signal from an external signal drive coil into a corresponding mechanical stimulation signal for delivery by bone conduction of the skull bone as an audio signal to the cochlea;

wherein each implant magnet comprises a pair of internal magnets lying in parallel planes which meet along a common junction with repelling like magnetic polarities facing towards each other; and wherein the magnetic polarities of each implant magnet are reversed from each other.

2. An implantable magnet arrangement according to claim 1, further comprising:

a connector member flexibly connecting and positioning the implant magnets a fixed distance from each other.

3. An implantable magnet arrangement according to claim 1, wherein each implant magnet further comprises a magnet housing enclosing the pair of internal magnets.

4. An implantable magnet arrangement according to claim 3, wherein the magnet housing is made of titanium material.

5. An implantable magnet arrangement according to claim 1, further comprising:

a spacer insert lying along the common junction and separating the internal magnets.

6. An implantable magnet arrangement according to claim 1, further comprising:

a magnet connector nut and bolt combination holding the internal magnets together along the common junction.

7. An implantable magnet arrangement according to claim 1, wherein at least one of the implant magnets is adapted for fixed attachment to the skull bone by a pair of radially opposed bone screws.

8. An implantable magnet arrangement according to claim 1, both of the implant magnets are adapted to transform the magnetic drive signal from the external signal drive coil into a corresponding mechanical stimulation signal for delivery by bone conduction of the skull bone as an audio signal to the cochlea.

9. An implantable magnet arrangement according to claim 1, wherein each internal magnet has a planar disk shape.

10. A hearing implant system having an implantable magnet arrangement according to any of claims 1-9.

* * * * *